United States Patent [19]

Ziemba

[11] 4,044,680

[45] Aug. 30, 1977

[54] REMOTELY CONTROLLED ELECTRONIC FUZE

[75] Inventor: Richard T. Ziemba, Burlington, Vt.

[73] Assignee: General Electric Company, Burlington, Vt.

[21] Appl. No.: 577,510

[22] Filed: May 14, 1975

[51] Int. Cl.[2] ..... F42C 11/00

[52] U.S. Cl. ..... 102/70.2 R; 102/74

[58] Field of Search ..... 102/70.2 R, 70.2 P, 102/75, 74

[56] References Cited

U.S. PATENT DOCUMENTS

| | | | |
|---|---|---|---|
| 2,411,788 | 11/1946 | Hammond, Jr. | 102/70.2 R |
| 3,646,371 | 2/1972 | Flad | 102/70.2 R |
| 3,703,145 | 11/1972 | Burkhardt et al. | 102/70.2 R |
| 3,750,583 | 8/1973 | White et al. | 102/70.2 R |
| 3,760,732 | 9/1973 | Schuster et al. | 102/70.2 R |
| 3,844,217 | 10/1974 | Ziomba | 102/70.2 R |

*Primary Examiner*—Charles T. Jordan
*Attorney, Agent, or Firm*—Bailin L. Kuch

[57] ABSTRACT

A weapon system comprises a fuze and a transmitter, said transmitter transmitting an RF coded pulse signal whose pulse repetition frequency presets the time base of the fuze and whose pulse combination code presets the mode of operation of the fuze, the fuze having an RF detector for receiving and detecting said signal, a logic circuit for reading said signal with respect to time base and mode of operation, and a timing circuit for enabling said detection for a predetermined time period at a predetermined time in flight.

5 Claims, 3 Drawing Figures

REMOTELY CONTROLLED ELECTRONIC FUZE

BACKGROUND OF THE INVENTION

1 Field of Art

This invention relates generally to fuze electronic actuating systems, and especially to systems having an inflight adjustment.

2. Prior Art

In my earlier disclosure, U.S. Pat. No. 3,714,898, there is shown an electronic, digital, time fuze, whose time base is introduced, during the entire interval of flight, over a radar command link at a rate which is inversely proportional to the desired projectile flight time.

In my subsequent disclosure, U.S. Pat. No. 3,670,652, there is shown an electronic, digital, time fuze having a counter which also serves as a serial programmer and which may be remotely preset while in flight to enable a proximity detector circuit at a first predetermined range, and to self detonate the fuze, if not sooner detonated by the proximity detector circuit, at a second predetermined range.

In my later disclosure, U.S. Pat. No. 3,844,217, there is shown an electronic, digital, time fuze whose time base may be initially preset mechanically before flight; and which time base subsequently may be changed during a predetermined interval during flight by a radar command link.

Disclosures of various schemes for selecting one out of several available modes or time delays of operation of a fuze are contained, for example, in U.S. Pat Nos. 3,604,356; 3,613,589; 3,672,302; 3,688,701; 3,703,145; 3,734,021; 3,853,063; 3,853,065; and 3,862,602.

RELATED CASE

Inventions disclosed, but not claimed in this application, are claimed in Ser. No. 577,496 filed May 14, 1975 by R.T. Ziemba and M.D. Egtvedt.

BRIEF SUMMARY OF THE INVENTION

It is an object of this invention to provide an electronic, digital, delayed detonator fuze whose delay may be remotely preset while the fuze is in flight.

An additional object is to provide the foregoing presetting at a time in flight requiring the minimum energy level in the command signals.

A feature of this invention is the provision of a weapon system comprising a fuze and a transmitter, said transmitter transmitting a RF signal whose pulse repetition rate presets the detonation delay of the fuze, the fuze having a timing circuit for providing the fuze with an otherwise predetermined detonation delay.

These and other objects, features and advantages of the invention will be apparent from the following specification thereof taken in conjunction with the accompanying drawing in which:

FIG. 3 is a schematic diagram of the fuze receiver and decoder unit of FIG. 2.

DESCRIPTION OF THE PREFERRED EMBODIMENT

Figure 1:
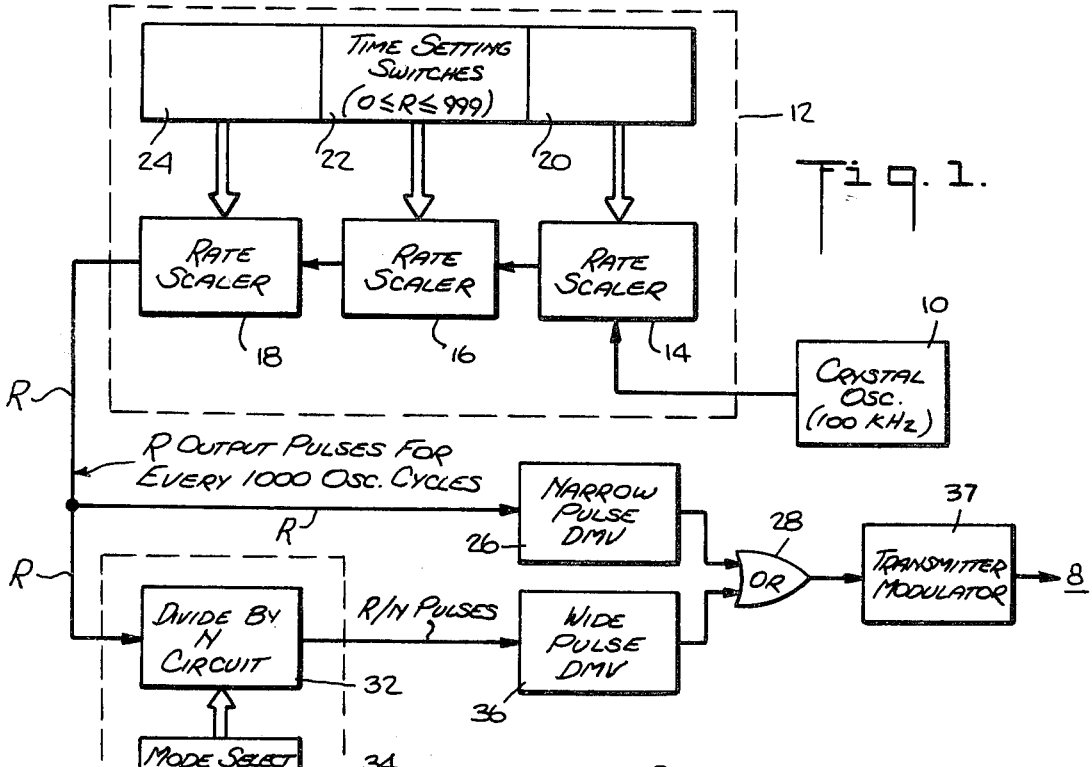
FIG. 1 is a simplified block diagram of the transmitter control unit of the weapon system embodying this invention.

The basic block diagram for the transmitter control unit is shown in FIG. 1. It has two functions. The first function is to provide an operator selected pulse repetition frequency (PRF) to preset the time base of the fuze, i.e. to set the time after firing at which the fuze detonator circuitry will be actuated. The second function is to provide an operator selected coded combination of pulses to preset the mode of operation of the fuze, i.e. to establish which one of several possible detonator circuits will be utilized.

In the particular embodiment shown, the transmitter 8 is normally on and transmitting. Alternatively, the control signal may be transmitted by the transmitter for a period of 250 milliseconds after the first motion of the projectile. In such a case, a signal responsive to the departure of the projectile from the tube is provided by any suitable means such as a firing signal or rocket motion detector. The time base informaton is contained in the PRF of the control signal. The mode selection information is contained on the sequential order of narrow (0.5 microsecond) and wide (1.5 microsecond) pulses in a repeated cycle of up to eight pulses.

A precision crystal oscillator 10 provides clock pulses at the rate of 100 KHz to a scaler 12 which provides a quantity R (ratio number) of output pulses for every 1000 clock pulses. This ratio can be set to any number from 1/1000 through 999/1000. The scaler 12 comprises three cascaded rate multipliers 14, 16 and 18 which are respectively controlled by three binary coded decimal thumbwheel switches 20, 22, and 24. The R pulses are fed to a narrow pulse monostable delay multivibrator 26 which provides corresponding "narrow" pulses to an OR gate 28. The R pulses are also fed to a scaler 30 which provides an output pulse (R/n) for every Nth R pulse. The scaler comprises a self resetting counter 32 which in effect divides R by n, and which is controlled by a binary coded decimal thumbwheel switch 34. The pulses from counter 32 are fed to a wide pulse monostable delay multivibrator 36 which provides corresponding "wide" pulses to the OR gate 28. The OR gate 28 allows the "wide" pulse to override the "narrow" pulse, so that the output signal from the OR gate 28 to the transmitter modulator is a 37 repeated cycle of P (up to seven) pulses, having a code arrangement of one wide marker pulse plus N narrow pulses. N can be set to any number from 3 through 7.

The following Table I gives the code combinations for the three herein utilized modes:

TABLE I

| Possible pulses: | 1(Marker) | 2 3 4 5 6 7 | P | N |
|---|---|---|---|---|
| Impact | 1 | 0 0 0 0 0 1(& repeat) | 6 | 5 |
| Airburst | 1 | 0 0 1(& repeat) | 3 | 2 |
| Canopy | 1 | 0 0 0 0 1(& repeat) | 5 | 4 |

Figure 2:
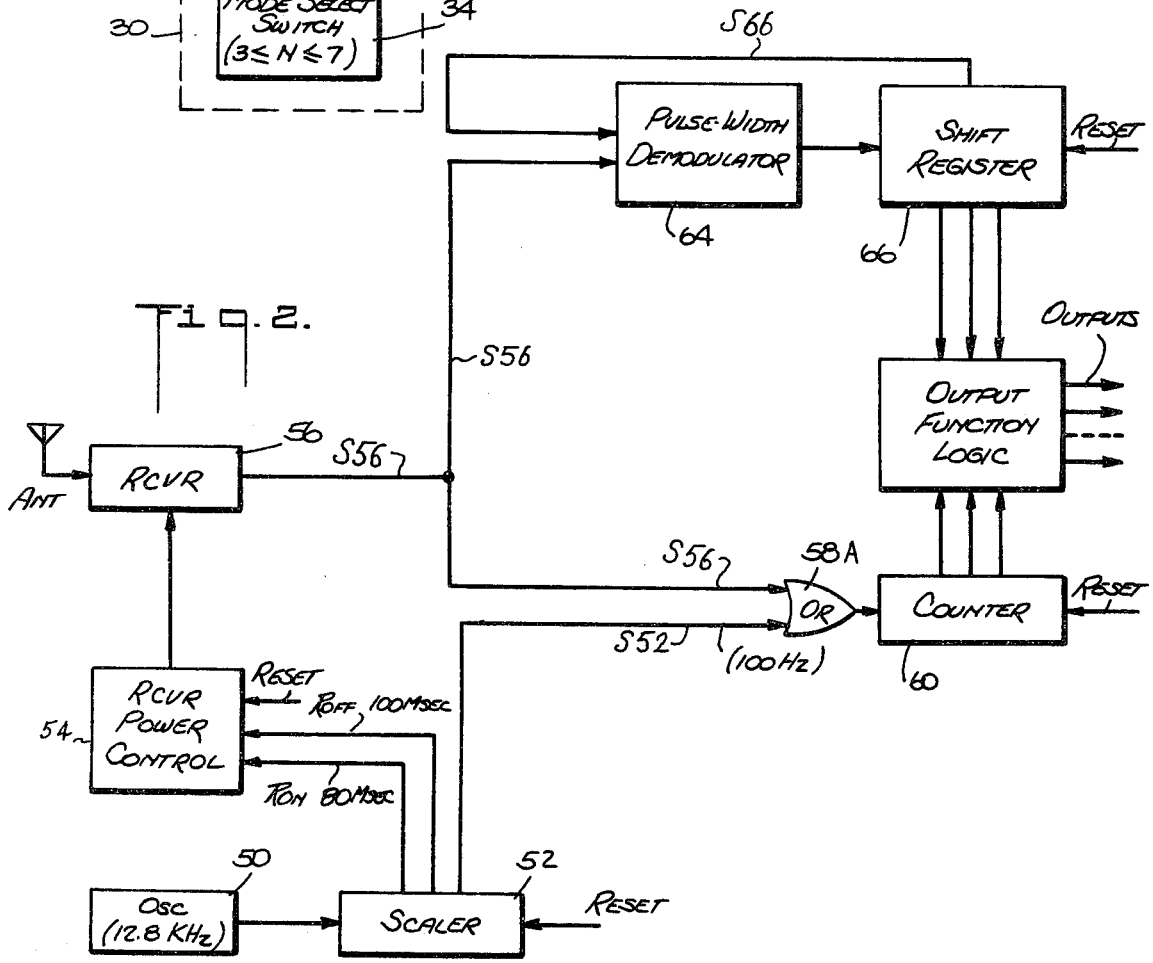
FIG. 2 is a simplified block diagram of fuze receiver and decoder unit of the weapon system embodying this invention.
Figure 4:
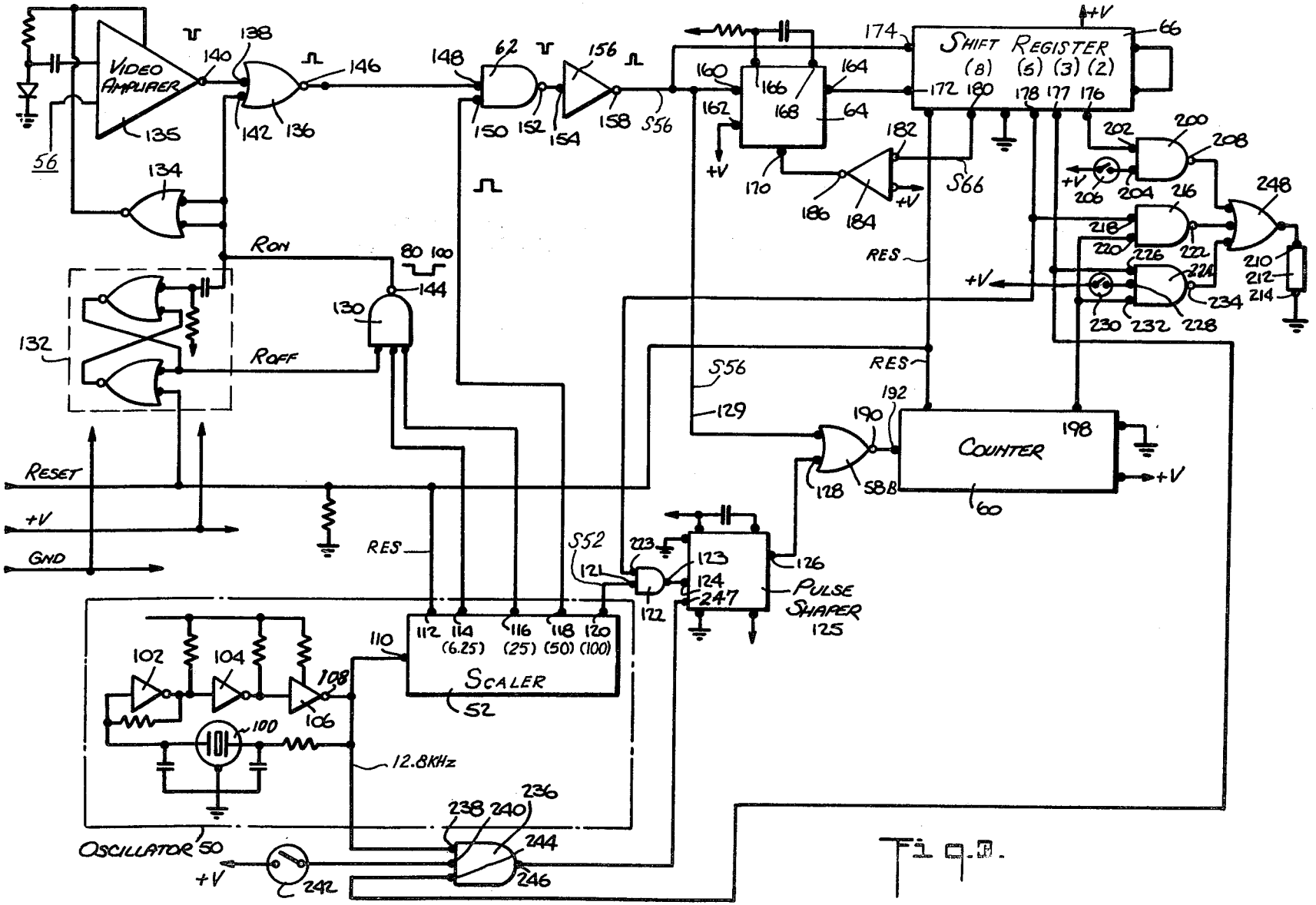

The basic block diagram for the fuze receiver and decoder unit if shown in FIG. 2. A conventional power supply such as a set-back actuated generator such as is shown in Ser. No. 533,682, filed Dec. 17, 1974, now U.S. Pat. No. 3,981,245, may be utilized to supply power +V and a reset pulse RES to the unit. The unit comprises a precision crystal oscillator 50 which provides clock pulses at a rate of 12.8 KHz to a scaler 52. The scaler provides a turn-on signal to a receiver power control 54 at 80 milliseconds after set-back, and provides a turn off signal at 100 milliseconds after set-back, so that the receiver 56 is on for a "window" period of 2 milliseconds.

During this "window" period only, any control pulses from the transmitter which are detected by the receiver 56 are fed to a first input of an OR gate 58A. Durng the entire period of operation of the oscillator 50, pulses are scaled by the scaler 52 and provided to a second input of the OR gate 58A at the rate of 100 Hz. The OR gate 58A passes both the scaler (52) "local" pulses and detected transmitter control pulses to the input of a counter 60, which counter, when it accumulates a full count of S12, initiates the fuze detonation function. The "local" pulses alone are fed to the counter 60 at the rate of one each 10 milliseconds, and will provide a full count in the counter 60 at 5120 milliseconds after set-back. Each transmitter control pulse which is passed to the counter 60 therefore will decrease the time at which the counter 60 reaches a full count by 10 milliseconds. The sooner the counter 60 reaches a full count, the sooner the fuze detonation function is obtained. Thus the PRF of the transmitter controls the time to detonation of the fuze. The signal paths S52, S52 and S66 include circuitry, as shown in FIG. 3.

During the "window" period also, control pulses from the transmitter which are detected by the receiver 56 are fed to a pulse width demodulator 64. The demodulator 64 provides a binary-0 pulse for each narrow control pulse and a binary-1 pulse for each wide control pulse to the input of a shift register 66. The shift register 66 has eight stages. When a binary-1 pulse enters the eighth stage, a pulse is provided by the shift register to disable the demodulator 64 and preclude the passing of additional pulses to the shift register. The location of a binary-1 in any one of the first five stages of the shift register is used to determine the selected mode of operation. The binary-1 in the eighth stage provides the format framing for the control signal. The minimum timing message must consist of (8 + N) RF pulses in order to insure receiving the complete mode select command during the window period. This represents a minimal limitation of the maximum time to fuze detonation; i.e. 15 pulse periods out of 512.

A specific mechanization of the fuze receiver/decoder is shown in FIG. 3 AND type and OR type gates are sometimes identified in the strictest sense as NAND gates and NOR gates, and sometimes in the more liberal, but perhaps more instructive, sense simply as AND gates and OR gates. This is merely a matter of whether "negative" or "positive" is taken as having a truth-value of 1 for the particular gate, and the reader should not be confused by the dual usage of AND and NAND for one and the same gate.

The oscillator 50 comprises a crystal tuning fork 100 and three high gain amplifiers 102, 104 and 106 in a series drive circuit having an output terminal 108 coupled to the input terminal 110 of the scaler 52. The scaler 52 is a self resetting counter having a reset input terminal 112; an output terminal 114 providing an output signal transition every 80 milliseconds after receipt of a signal at the input terminal 110, an output terminal 116 providing an output signal transition every 20 milliseconds after input, an output terminal 118 providing an output signal transition every 10 milliseconds after input, and an output terminal 120 providing an output signal transition every 5 milliseconds after input from 110. The oscillator provides an input signal of 12.8 KHz to the input terminal 110, and the output terminal 120 provides an output signal of 100 Hz to one input terminal 121 of an NAND gate 122 whose output terminal 123 is coupled to the input terminal 124 of a pulse shaper 125. The pulse shaper 125 is a delay multivibrator which is used to shorten the period of each pulse provided by the output terminal 120 of the scaler 52 to 1 microsecond, and has an output terminal 126 coupled to one input terminal 128 of the NOR gate 58B. The receiver power control 54 comprises a NAND gate 130, a bistable flip-flop 132, and a NOR gate 134. The control 54 serves to provide power to the receiver video amplifier at 80 milliseconds after the application of power to the fuze, and to withdraw power at 100 milliseconds after the application of power so that the receiver 56 is on to receive signals from the transmitter 8 for a period of 20 milliseconds. The beginning and the end of this "on" period are indicated by the presence of the signals Ron and Roff, respectively. A NOR gate 136 has one input terminal 138 coupled to the output terminal 140 of the video amplifier 135, and another input terminal 142 coupled to the output terinal 144 of the NAND gate 130, and provides buffering and inversion of the signal from the video amplifier. The output terminal 146 of the NOR gate 136 is coupled to one input terminal 148 of the NAND gate 62, whose second input terminal 150 is coupled to the scaler terminal 118. The NAND gate 62 passes pulses when the terminal 118 is high, thus shortening the effective RF window to the last ten millisecond period of the twenty millisecond period that the video amplifier 135 is turned on. This provides an initial ten millisecond period for the video amplifier 135 to stabilize from turn-on transients. It may be noted that terminal 118 enables the NAND gate 62 for the last ten milliseconds of every twenty millisecond period, but the NOR gate 136 is enabled for only the one twenty millisecond period after the initial application of power to the fuze. The output terminal 152 is coupled to the input terminal 154 of an inverter-amplifier 156 whose output terminal 158 is coupled to the input terminal 160 of the pulse width demodulator 64. The demodulator is a delay multivibrator having a delay period half way between the wide and narrow pulses. It is triggered by a positive signal transition to terminal 160 with terminal 162 held high. Its output terminal 164 is normally high, but goes low on triggering, and remains low for a period determined by the R-C timing components connected to terminals 166 and 168. This period is one microsecond. The clear input terminal 170 must be held high to enable delay multivibrator operation; when the terminal 170 goes low, the delay multivibrator 64 is immediately reset (terminal 164 returns to high) and is held in this state so long as the terminal 170 is held low.

The shift register 66 has an input clock terminal 172 coupled to the terminal 164 and an input signal terminal 174 coupled to the terminal 158. The shift register is clocked by the trailing edge of the pulse width demodulator's output pulse, which is one microsecond after its leading edge, causing either a 0 or a 1 to be read at the terminal 174, corresponding respectively to a narrow or a wide signal pulse from the inverter 156. The shift register has eight stages, of which stage two has an output terminal 176, stage three has an output terminal 177, stage five has an output terminal 178, and stage eight has an output terminal 180. The terminal 180 is coupled to the input terminal 182 of an inverter-amplifier 184, whose output terminal 186 is coupled to the clear terminal 170 of the demodulator 64. When a binary-1 reaches stage eight of the shift register, it sets the clear terminal 170 low and thus disables the demodulator, halting further clock pulse to the shift register.

The NOR gate 58B has an output terminal 190 coupled to the input terminal 192 of the counter 60. The counter has at least ten stages, of which stage 10 has an output terminal 198.

An "Impact Mode Select" NAND gate 200 has a first input terminal 202 coupled to the shift register's second stage output terminal 176, and a second input terminal 204 coupled to a hard impact responsive, latching switch 206 and which is coupled to a positive voltage +V. The output terminal 208 of the gate 200 is coupled to one terminal of OR gate 248 and subsequently to one terminal 210 of a conventional detonator 212 whose other terminal 214 is coupled to ground.

An "Airburst Mode Select" NAND gate 216 has a first input terminal 218 coupled to the shift register's fifth stage output terminal 178, and a second input terminal 220 coupled to the counter's tenth stage output terminal 198. The output terminal 222 of the gate 216 is coupled to one terminal of OR gate 248 and subsequently to one terminal 210 of the detonator 212. The second input terminal 223 of the AND gate 122 is coupled to the shift register's fifth stage output terminal 178.

A first "Canopy Mode Select" NAND gate 224 has a first input terminal 226 coupled to the shift register's third stage output terminal 177, and a second input terminal 228 coupled to a first soft impact responsive latching switch 230 and which is coupled to a positive voltage source. A third input terminal 232 of the gate 224 is coupled to the counter's tenth stage output terminal 198, and its output terminal 234 is coupled to one terminal of OR gate 248 and subsequently to one terminal 210 of the detonator 212. A second "Canopy Mode Select" AND gate 236 has a first input terminal 238 coupled to the oscillator output terminal 108, a second input terminal 240 coupled to a second soft impact responsive latching switch 242 and which is coupled to a positive voltage source, and a third input terminal 244 which is coupled to the shift register's third stage output terminal 177. The output terminal 246 of the gate 236 is coupled to the input terminal 247 of the pulse shaper 125.

In operation, if the "Impact Mode" has been selected, a binary-1 digit will be stored in the second stage of the shift register 66, and binary-0 digits wll be stored in the third and fifth stages of the shift register providing a high signal to terminal 202. Upon a hard impact, e.g. contact with the ground or other rigid target, the switch 206 will latch closed, providing a high signal to terminal 204. Upon both of its input terminals 202 and 204 becoming concurrently high, the NAND gate 200 will conduct, energizing the detonator 212 through OR gate 248.

If the "Airburst Mode" has been selected, a binary-1 digit will be stored in the second and fifth stages of the shift register, and a binary-0 digit will be stored in the third stage of the shift register, providing a high signal to terminals 202, 218 and 223. The high input terminal 202 activates the "Impact Mode", described in the preceding paragraph, which provides a "back-up", if impact occurs before the "Airburst" junctions. The NAND gate 122 will pass pulses from the scaler 52 to the counter 60, via the PULSE SHAPER 125 and the NOR gate 58B, and when the counter is filled, the terminal 198 will be high, making terminal 220 high. Upon both of its input terminals becoming concurrently high, the NAND gate 216 will conduct, energizing the detonator 212 through OR gate 248.

If the "Canopy Mode" has been selected, a binary-1 digit, will be stored in the third stage of the shift register, and binary-0 digits will be stored in the second and fifth stages of the shift register providing a high signal to terminals 226 and 244. Upon an impact, e.g. contact with the jungle canopy, the switches 230 and 242 will latch closed, providing high signals to terminals 228 and 240 respectively. The AND gate 236 will pass pulses from the oscillator to the counter, by-passing the scaler 52, via the pulse shaper 125 and the NOR gate 58B, and when the counter is filled, the terminal 198 will be high, making terminal 232 high. Upon all of its input terminals becoming concurrently high, the NAND gate 224 will conduct, energizing the detonator 212 through OR gate 248. If a shorter delay between canopy impact and detonation is required, pulses are preset int counter 60 via the remote set input line 129 during the fuze set operation. Since the counter is partially filled via the remote set input line, the period required to fill the counter 60 is reduced (following canopy impact) and thus the time-to-detonation is shortened. Note that in the canopy mode, since the scaler 52 is by-passed, the counter 60 is filled at a substantially higher rate than in the other selected modes. This is to provide for high speed timing during the canopy penetration.

The shift register may of of the type 4015A, and the scaler and the counter may each be of the type 4040A, as shown in "CMOS Integrated Circuit Data Book" of October 1973 by Solid State Scientific Inc. The pulse shaper and the pulse width demodulator may each be of the type 14528 as shown in "ADI-218" of 1972 by Motorola Inc.

What is claimed is:

1. A weapon system comprising:

a projectile having a fuze, said fuze including detonator means, timing means having output means for providing an output timing signal after a predetermined period of time, detonator function means having output means coupled to said detonator means for providing a signal to actuate said detonator means, impact responsive means coupled to said timing means for providing an output signal in response to an impact after a period of flight, said impact responsive means upon impact causing said timing means to commence timing said predetermined period of time to provide said output timing signal to cause said detonator function means to actuate said detonator means at the end of said period of time, said timing means including a local oscillator, a counter coupled to said oscillator for receiving and accumulating pulses therefrom, said impact responsive means normally disabling said coupling between said oscillator between said oscillator and said counter and upon impact enabling said counter to thereafter receive pulses from said oscillator and upon accumulating a predetermined count to provide said output timing signal.

2. A weapon system according to claim 1, wherein:

said timing means further includes a radio receiver adapted to receive signals from radio transmitter means, coupled to said counter, for providing pulses to said counter in response to such signals, said counter accumulating said pulses in addition to said oscillator pulses.

3. A weapon system according to claim 2, further including:

radio transmitter means for providing signals to said radio receiver to cause said radio receiver to provide pulses to said counter.

4. A weapon system comprising:

a projectile having a fuze, said fuze including detonator means, timing means having output means for providing an output timing signal after a predetermined period of time, detonator function means having output means coupled to said detonator means for providing a signal to actuate said detonator means, impact responsive means coupled to said timing means for providing an output signal in response to an impact after a period of flight, said impact responsive means upon impact causing said timing means to commence timing said predetermined period of time to provide said output timing signal to cause said detonator function means to actuate said detonator means at the end of said period of time, said timing means includes a local oscillator, a scaler, a counter, first means, including impact responsive means, for normally coupling said oscillator to said scaler, and said scaler to said counter, for causing said counter to receive and to accumulate pulses at a fraction of the oscillator rate, and upon impact, coupling said oscillator to said counter, for causing said counter to receive and to accumulate pulses at the full oscillator rate, said counter upon accumulating a predetermined count, providing said output timing signal.

5. A method of controlling the delay after impact after a period of flight of the detonation of a fuze comprising:

projecting said fuze into flight, providing a series of pulses to a counter during flight to preload an initial predetermined count into said counter, providing a first signal in response to the impact of the fuze, providing a series of clock pulses to said counter in response to said first signal, accumulating said pulses, and providing a second signal in response to accumulating a second predetermined count; and providing detonation in response to said second signal.

* * * * *

UNITED STATES PATENT OFFICE

CERTIFICATE OF CORRECTION

Patent No. 4,044,680 Dated August 30, 1977

Inventor(s) Richard T. Ziemba

It is certified that error appears in the above-identified patent and that said Letters Patent are hereby corrected as shown below:

Column 2, line 60 change "if" to --is--.
Column 3, line 2, change "2" to --20--; line 7, change "Durng" to --During--;
line 24, change "S52, S52" to --S52, S56--.
Column 4, line 22 change "terinal" to --terminal-- and "NAND" to --NOR--.
Column 6, line 19, change "int" to --into--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*